US006845545B2

(12) United States Patent
Han et al.

(10) Patent No.: US 6,845,545 B2
(45) Date of Patent: Jan. 25, 2005

(54) APPARATUS TO CLOSE A DOOR OF A REFRIGERATOR

(75) Inventors: Jae-Myeong Han, Kwangju (KR); Myung-Wouk Kim, Kwangju (KR); Yong-Pil Park, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/378,902

(22) Filed: Mar. 5, 2003

(65) Prior Publication Data

US 2004/0040118 A1 Mar. 4, 2004

(30) Foreign Application Priority Data

Sep. 4, 2002 (KR) ..... 2002-53286
Sep. 4, 2002 (KR) ..... 2002-53288

(51) Int. Cl.[7] ..... E05F 1/08

(52) U.S. Cl. ..... 16/277; 16/286; 16/50; 312/405; 312/319.2

(58) Field of Search ..... 16/277, 281, 286, 16/287, 80, 70, 50, 374, 375, 319; 312/401, 405, 325, 326, 329, 319.2; 49/399, 109

(56) References Cited

U.S. PATENT DOCUMENTS 678,790 A * 7/1901 Nushawg et al. ..... 16/66
2,189,818 A * 2/1940 Murrin ..... 16/291
5,027,473 A * 7/1991 Hottmann ..... 16/286
5,271,652 A * 12/1993 Watanabe et al. ..... 296/36
5,522,656 A * 6/1996 Jenkins ..... 292/79
5,896,619 A * 4/1999 Koopman ..... 16/50
5,931,554 A * 8/1999 Koopman ..... 312/405
6,629,336 B2 * 10/2003 Hosaka et al. ..... 16/327
6,684,453 B2 * 2/2004 Wang ..... 16/54

FOREIGN PATENT DOCUMENTS

DE 29611392 U1 * 8/1996 ..... E05D/11/10
EP 692598 A1 * 1/1996 ..... E05F/1/12
FR 2030784 A * 11/1970 ..... E05F/1/00
KR 0142056 2/1996
KR 0109848 5/1996

* cited by examiner

*Primary Examiner*—Chuck Mah
(74) *Attorney, Agent, or Firm*—Staas & Halsey LLP

(57) ABSTRACT

An apparatus to automatically close a refrigerator door when the door is opened at a predetermined angle or less. The apparatus includes a hinge mechanism having a first hinge shaft provided at the door, which allows the door to be coupled to a refrigerator cabinet and allows the door to be rotated about the hinge shaft, a tension spring provided at the refrigerator cabinet to apply the door with a tension force for closing the door, and a unit to asborb shock generated when the door is closed by the tension spring, and the a unit to absorb shock includes a housing coupled to the cabinet, and a movable shaft which is received in the housing at its one end and connected to the door at the other end to be linearly moved in the housing, and wherein the tension spring is connected to the cabinet at its one end and connected to the movable shaft at the other end to apply the door with a tension force of closing the door. Thus, when the door is opened at an angle of 90 degrees or less, the door is automatically closed and when the door is opened at an angle greater than 90 degrees, the door remains in its position. Accordingly, use of the refrigerator is convenient, and the maximum rotation angle of the door can be controlled according to a user's desire.

12 Claims, 17 Drawing Sheets

APPARATUS TO CLOSE A DOOR OF A REFRIGERATOR

CROSS-REFERENCE TO RELATED APPLICATIONS

This application claims the benefit of Korean Application No. 2002-53286, filed Sep. 4, 2002 and Application No. 2002-53288, filed Sep. 4, 2002, in the Korean Intellectual Property Office, the disclosures of which are incorporated herein by reference.

BACKGROUND OF THE INVENTION

1. Field of the Invention

The present invention relates to an apparatus to close the door of a refrigerator, and more particularly to an apparatus to close the door of a refrigerator, which is adapted to automatically close the door when the door is opened at a predetermined angle or less, and to maintain the door at a predetermined angle when the door is opened at an angle larger than the predetermined angle, and which is adapted to control the maximum opening angle of the door.

2. Description of the Related Art

In general, a refrigerator includes a freezing compartment, a refrigerating compartment, and a door to close the freezing compartment and the refrigerating compartment. Such a refrigerator is a home electric appliance, which is intended to generate cool air to freeze food in the freezing compartment and to keep food in the refrigerating compartment in a fresh state, thereby allowing food liable to spoil to be preserved for a long period of time. In such a refrigerator, a door serves to shield inside air in the freezing and refrigerating compartments from the outside air.

Where a door of a refrigerator is inadvertently maintained in a state of being opened after use of the refrigerator, cool air in the freezing or refrigerating compartment leaks outside therefrom, thereby causing excessive loss of electric power and spoiling of food stored in the affected compartments. To overcome this disadvantage, many attempts have been made to provide a refrigerator which is designed to enable its door to be automatically closed when a user releases the door, after the door is opened within a predetermined range of rotating angle.

Referring to FIGS. 1 to 4, there is shown a conventional apparatus to close the door of a refrigerator, which is adapted to enable the door to be automatically closed. Such a conventional apparatus will now be described with reference to FIGS. 1 to 4.

FIG. 1 shows a large-sized refrigerator, for which demand is increasing these days. The refrigerator includes a freezing compartment and a refrigerating compartment defined in a cabinet at its left and right sides. The refrigerator further includes a pair of leg parts 101 disposed under the cabinet. To close the freezing and refrigerating compartments, the refrigerator is provided with a pair of doors 102 and 103, which are pivotally coupled to the leg parts 101 to be opened and closed forwardly.

FIG. 2 is an exploded perspective view showing the circled portion "A" in FIG. 1. As shown in FIG. 2, the door 103 is provided at its right and lower end with a hinge hole 201 into which a hinge shaft 203*a*, formed at a hinge shaft bracket 203, is rotatably fitted at its one end. The hinge shaft bracket 203 is joined to the lower end of the door 103 by a fastening element such as a bolt. A hinge hole bracket 202 is joined to the right and lower end of the cabinet 100, i.e., a right leg part 101, by bolts. The hinge hole bracket 202 includes an extension portion 202*a*, which is bent forward. The extension portion 202*a* is provided with a hinge hole 202*b* into which the other end of the hinge shaft 203*a* is rotatably inserted. The extension portion 202*a* is provided around the hinge hole 202*b* with a cam-riser-low 202*c*, and the hinge shaft bracket 203 is provided around the hinge shaft 203*a* with a cam-riser-up 203*b*, which is engaged with the cam-riser-low 202*c*.

An operation of the apparatus to dose a refrigerator door will now be described with reference to FIGS. 3 and 4.

FIG. 3 shows the circled portion "A" in FIG. 1, in which the door 103 is closed, and FIG. 4 shows the circled portion "A" in FIG. 1, in which the door 103 is somewhat open, i.e., rotated, and thus somewhat raised by the cam mechanism 202*c* and 203*b*. In this state, when a user releases the door 103, the door 103 is automatically closed by its own weight with the help of the cam mechanism, and thus returned to the position shown in FIG. 3. That is, the door 103 is automatically closed without any additional external force.

However, such a conventional apparatus to dose a refrigerator door which utilizes the above cam mechanism 202*c* and 203*b*, has disadvantages as follows. First, since the cam-riser-low 202*c* and the cam-riser-up 203*b* are in frictional contact with each other at their facing slanted cam faces during rotation of the door, the slanted cam faces of the cam mechanism become worm. Furthermore, because of the configuration of the cam mechanism 202*c* and 203*b*, though the door 103 is automatically closed by the cam mechanism when the door 103 is opened within a range of about 0 to 45 degrees, the door 103 must be rotated within the range of 0 to 45 degrees by an external force of a user when the door is rotated beyond the range of 0 to 45 degrees. In addition, since the door 103 is typically set to be rotated to the maximum rotation angle of 235 degrees, the door cannot be maintained in place at a rotation angle other than the maximum rotation angle. Since the door is raised during its opening operation due to the configuration of the cam mechanism, a user must apply the door with additional external force. Finally, since the door is not provided with a mechanism to absorb shock generated when the door is closed, there is a risk that articles stored on shelves of the door may fall down or drop from the shelves due to shock when the door is quickly closed.

SUMMARY OF THE INVENTION

Accordingly, it is an aspect of the present invention to provide an apparatus to close a refrigerator door, which is intended to enable the door to be automatically and smoothly closed when the door is opened within a range of 0 to 90 degrees, and to enable the door to be maintained in place when the door is opened within a range of 90 to 135 degrees.

Additional aspects and advantages of the invention will be set forth in part in the description which follows and, in part, will be obvious from the description, or may be learned by practice of the invention.

The foregoing and/or other aspects of the present invention are achieved by providing an apparatus to close a door of a refrigerator, comprising: a hinge mechanism having a first hinge shaft provided at the door, which allows the door to be coupled to a refrigerator cabinet and allows the door to be rotated about the hinge shaft; a tension spring provided at the refrigerator cabinet to apply the door with a tension force of closing the door; and a unit to absorb shock generated when the door is closed by the tension spring, and the unit to absorb shock includes a housing coupled to the cabinet, and a movable shaft which is received in the housing at its one end connected to the door and at the other end to be linearly moved in the housing, and wherein a tension spring is connected to the cabinet at its one end and connected to the movable shaft at the other end to provide the door with a tension force to close the door.

BRIEF DESCRIPTION OF THE DRAWINGS

The above and other objects and advantages of the present invention will become apparent and more appreciated from the following detailed description of the preferred embodiments, taken in conjunction with the accompanying drawings of which:

FIGS. 11 to 17 show a modified embodiment of the apparatus shown in FIG. 5.

DETAILED DESCRIPTION OF THE PREFERRED EMBODIMENTS

Figure 1:
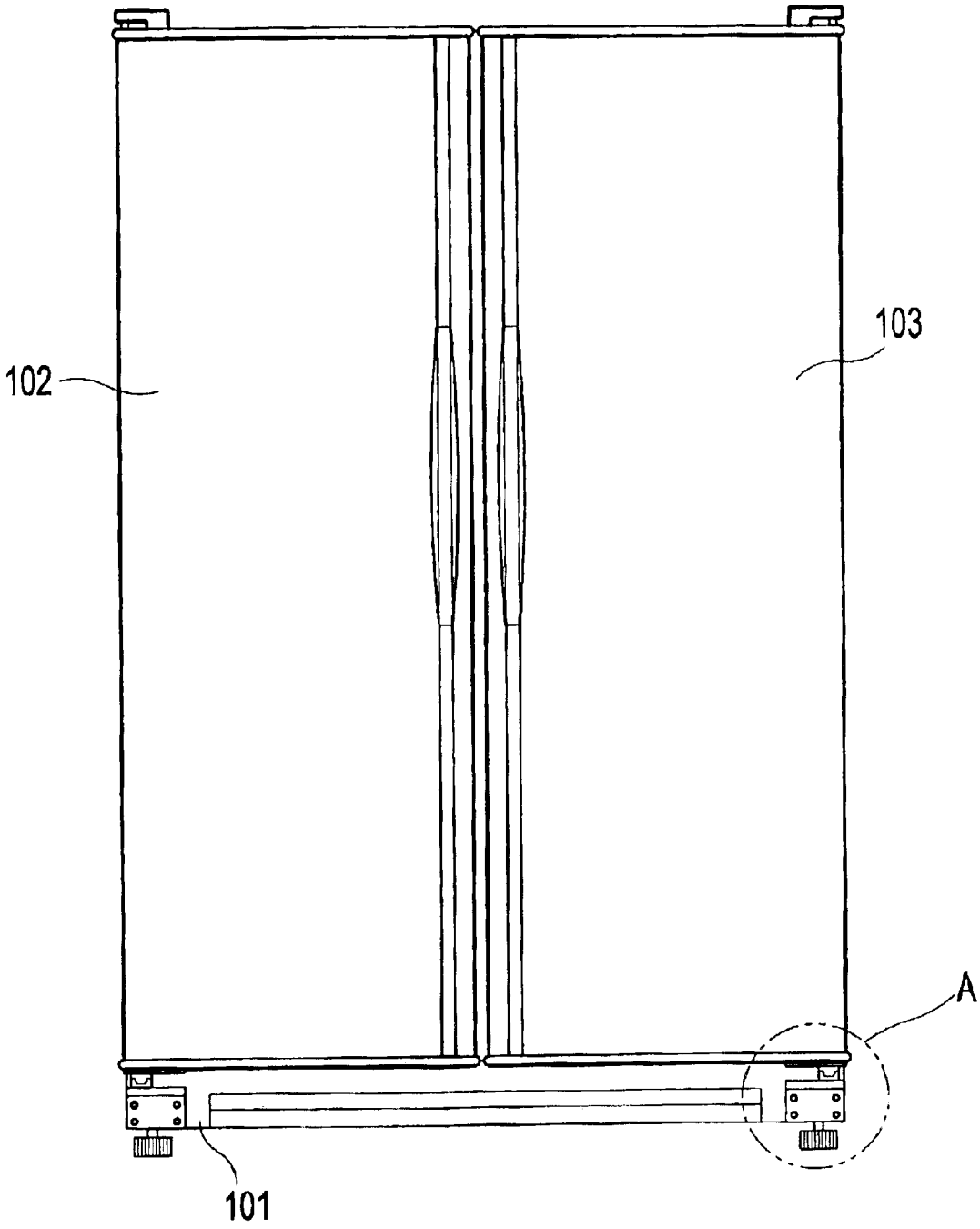
Fig. 1 PRIOR ART
FIG. 1 is a front elevation view showing a conventional refrigerator.
Figure 2:
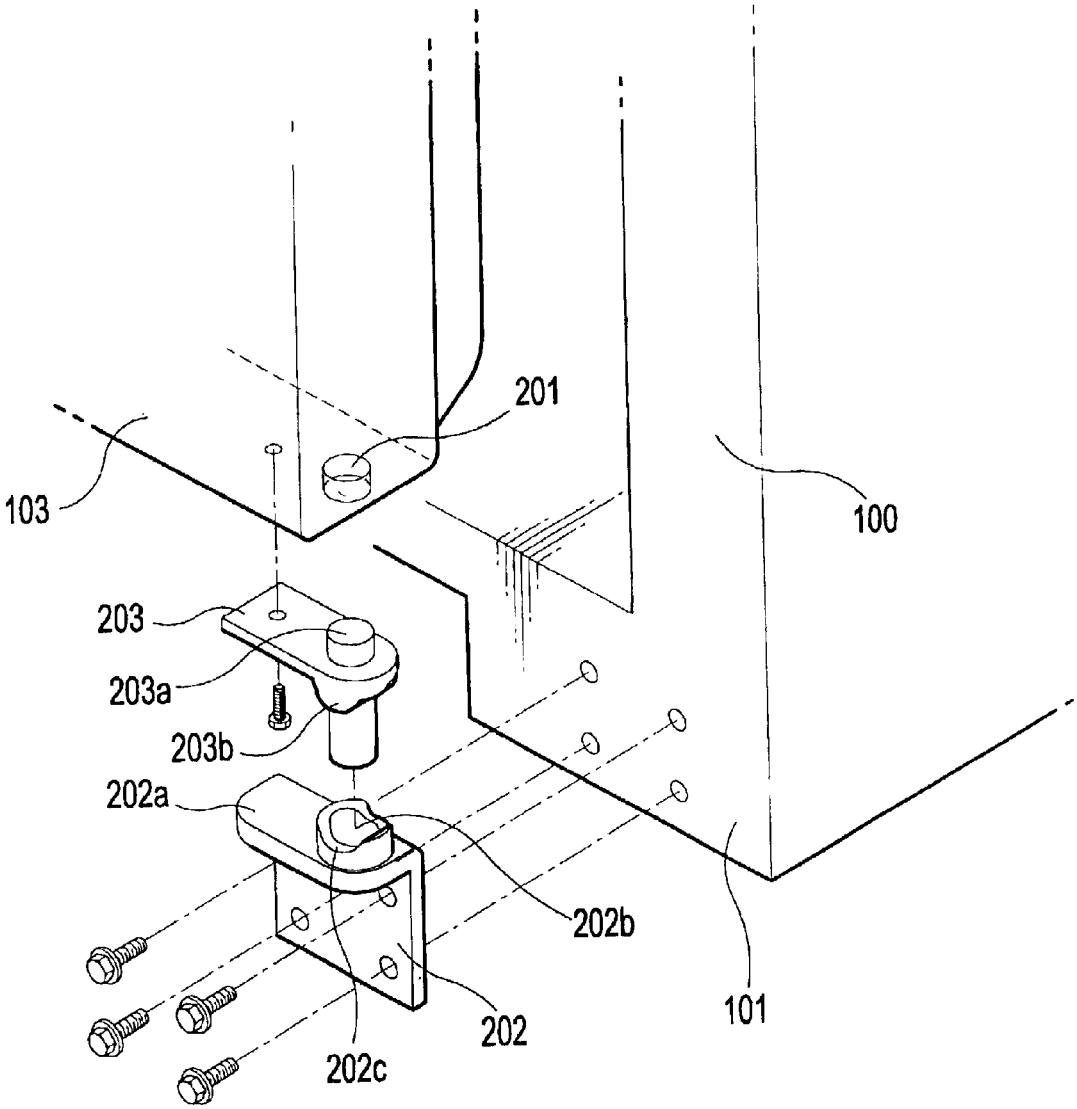
Fig. 2 PRIOR ART
FIG. 2 is an exploded perspective view showing circled portion "A" in FIG. 1.
Figure 3:
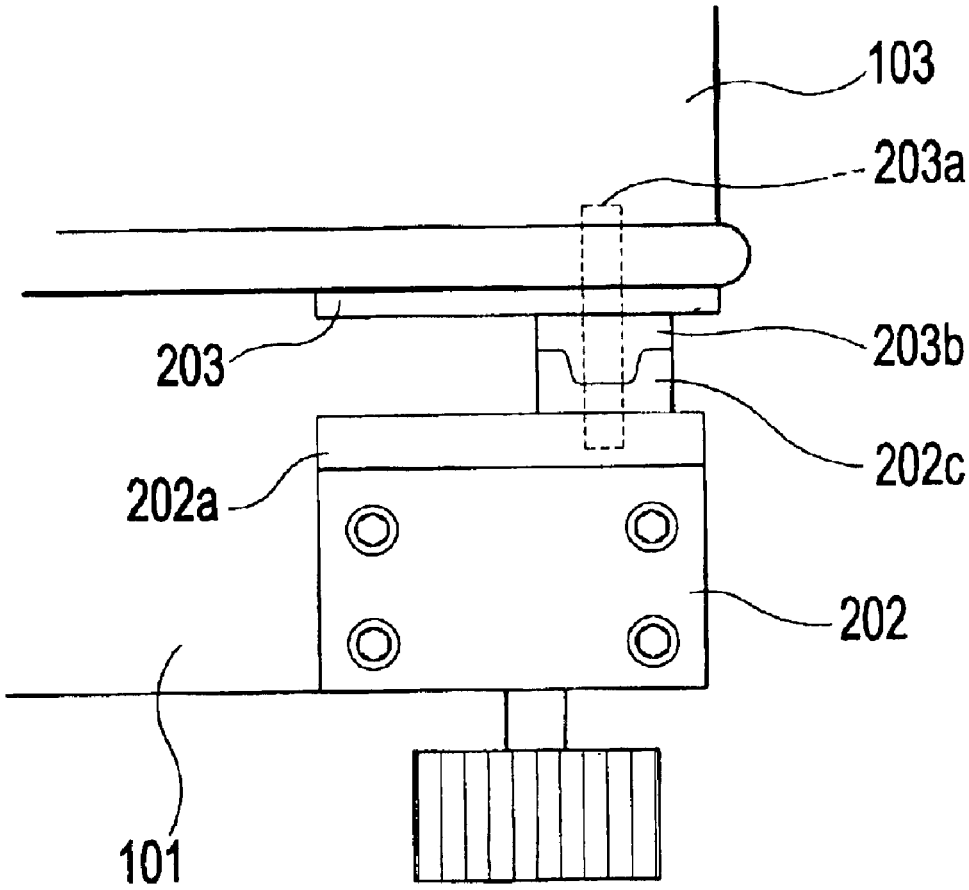
Fig. 3 PRIOR ART
FIGS. 3 and 4 are front views showing the circled portion "A" in FIG. 1.
Figure 4:
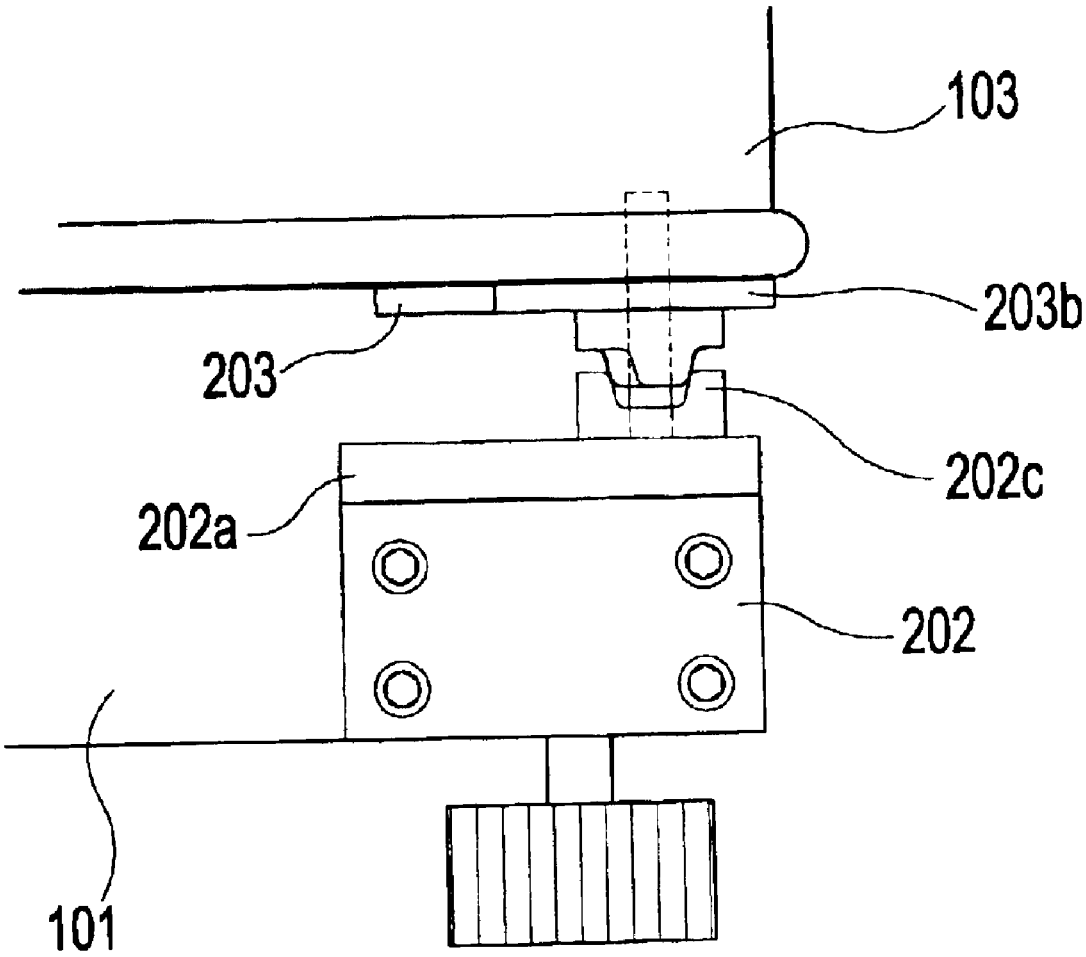
Fig. 4 PRIOR ART

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 5:
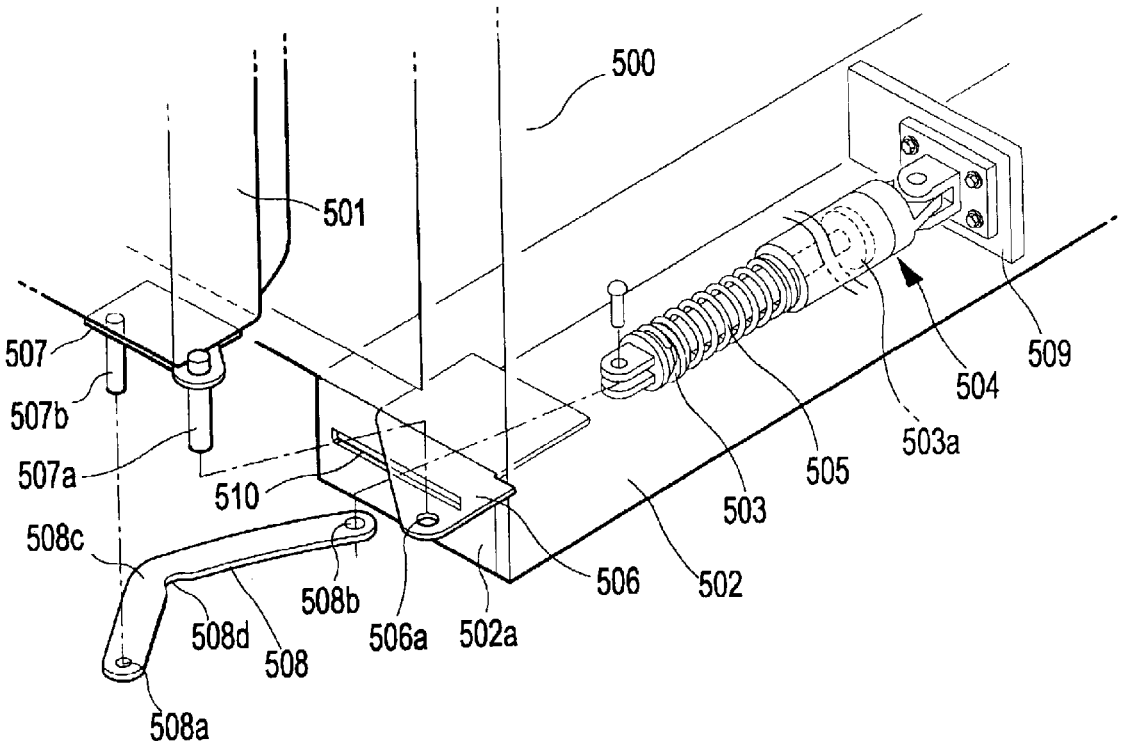
FIG. 5 is an exploded perspective view of an apparatus to close a refrigerator door according to an embodiment of the present invention.

FIG. 5 is an exploded perspective view showing an embodiment of the present invention. As shown in FIG. 5, a cabinet 500 of a refrigerator includes a leg part 502 serving as a cylinder. The leg part 502 is provided therein with a movable shaft 503, adapted to be linearly moved, and a housing 504, into which the movable shaft 503 is partially inserted. The housing 504 is swingably connected to a mounting plate 509, integrally joined to a rear end of an inside of the leg part 502. The movable shaft 503 is provided at its rear end with a piston 503*a*, which is inserted into the housing 504, thereby defining an enclosed space therein. The enclosed space of the housing 504 is filled with air. Consequently, the housing 504, the piston 503*a*, and the air filled therein serve as a gas shock absorber to absorb shock generated at the time of closing of the door. A tension spring 505 is inserted on the movable shaft 503 such that the tension spring 505 is coupled to the front end of the movable shaft 503 at its front end and coupled to the front end of the housing 504 at its rear end. Accordingly, when the movable shaft 503 is moved forward, the movable shaft 503 is subjected to a rearward pulling force by the tension spring 505, thereby causing the door 501 to be closed.

Furthermore, the leg part 502 is provided at its front end with a hinge hole bracket 506 by fastening elements. The hinge hole bracket 506 includes a hinge hole 506*a* to allow the door 501 to be pivotally coupled thereto. The door 501 is provided with a hinge shaft bracket 507 joined at its lower end. The hinge shaft bracket 507 is provided at its lower surface with a first hinge shaft 507*a*, which is rotatably inserted into the hinge hole 506*a* of the hinge hole bracket 506. The hinge shaft bracket 507 is further provided at its lower surface with a second hinge shaft 507*b*, which is positioned to be spaced from the first hinge shaft 507*a*. The second hinge shaft 507*b* is pivotally connected to the front end of a connecting lever 508. The connecting lever 508 is connected to the front end of the movable shaft 503 at its other end. Consequently, the tension force generated from the tension spring 505 is transmitted to the door 501 via the connecting lever 508. To this end, the connecting lever 508 is provided at its front and rear ends with hinge holes 508*a* and 508*b*. The connecting lever 508 is provided with a bent portion 508*c* to allow the door to be rotated to the maximum rotation angle, and is provided at its bent portion with a seat cut 508*d*, which is engaged to the first hinge shaft 507*a*. As will be appreciated, since the connecting lever 508 must pass through the front plate 502*a* of the leg part 502 to be positioned at both the inside and outside of the leg part 502, the front plate 502*a* of the leg part 502 is provided with a connecting lever hole 510 so as to allow the connecting lever 508 to freely pass therethrough. The connecting lever hole 510 is preferably shaped such that the movable shaft 503 cannot project to the outside therethrough.

An operation of the apparatus to dose a refrigerator door according to the present invention, which is constructed in the above-mentioned way, will now be described.

Figure 6:
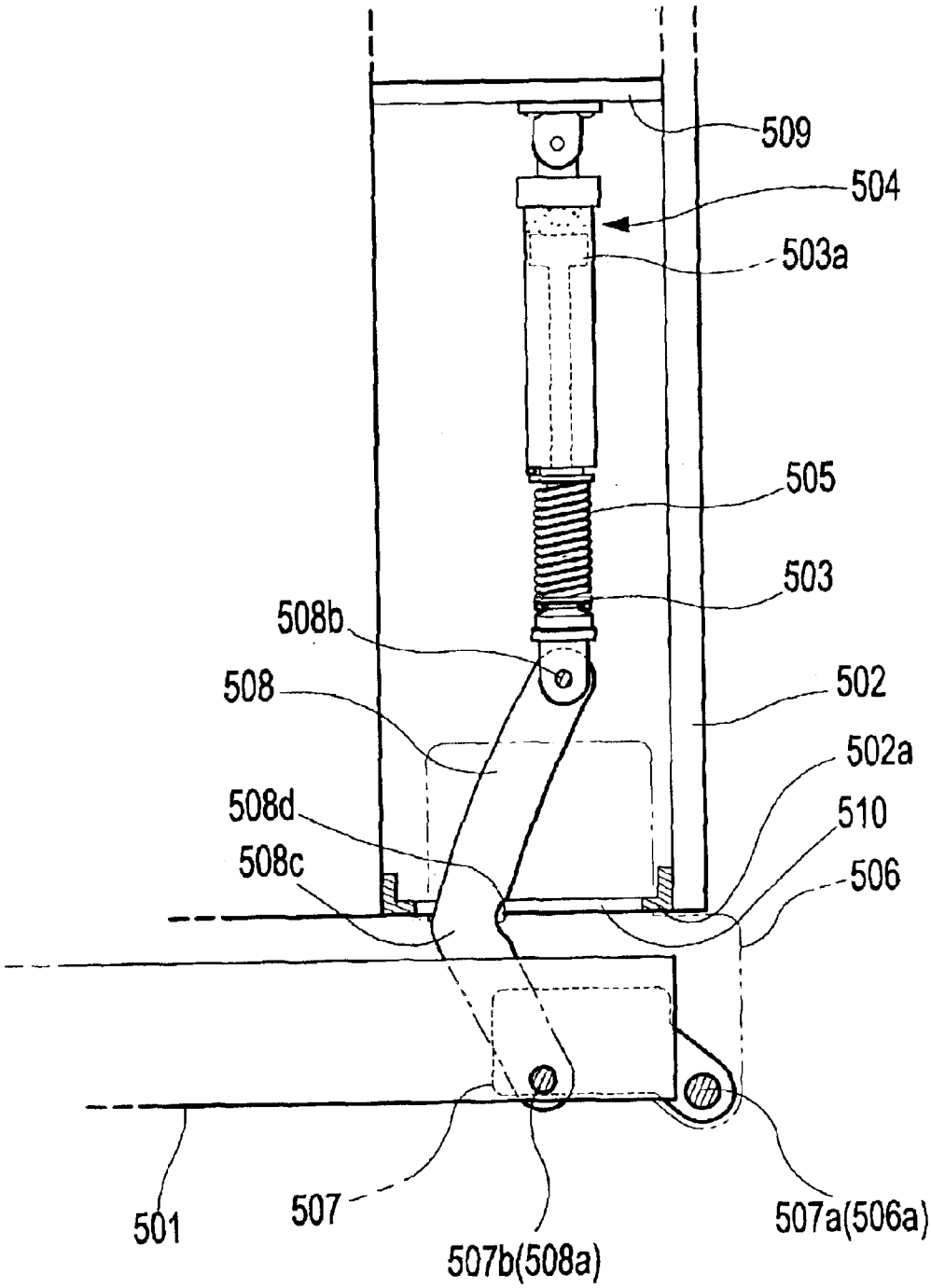
FIG. 6 is a plan view of the apparatus shown in FIG. 5.
Figure 7:
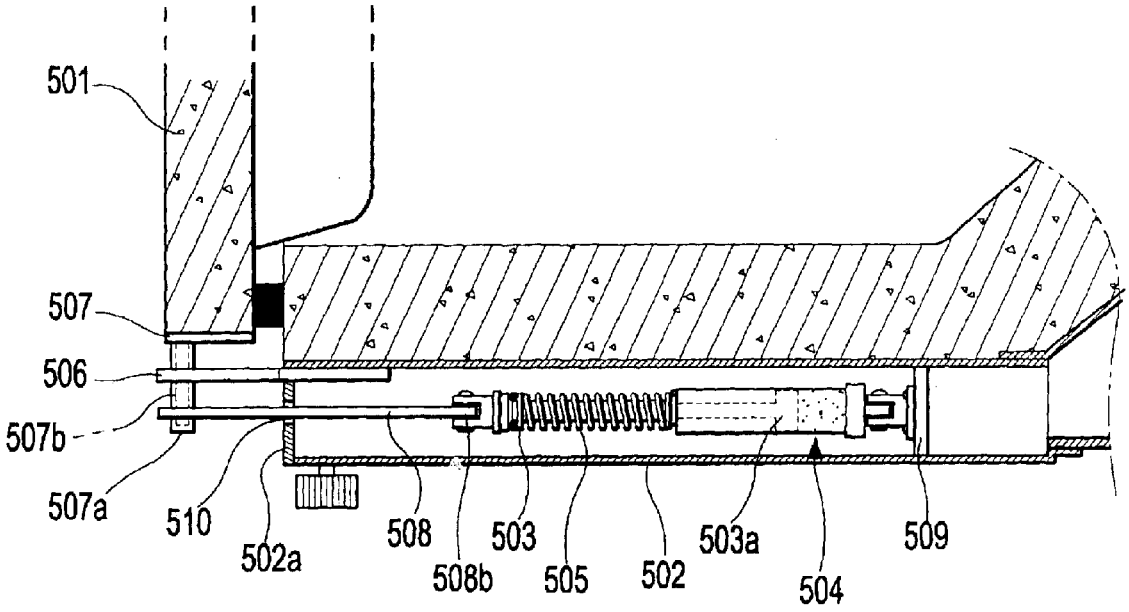
FIG. 7 is a side cross-sectional view of the apparatus shown in FIG. 5.
Figure 8:
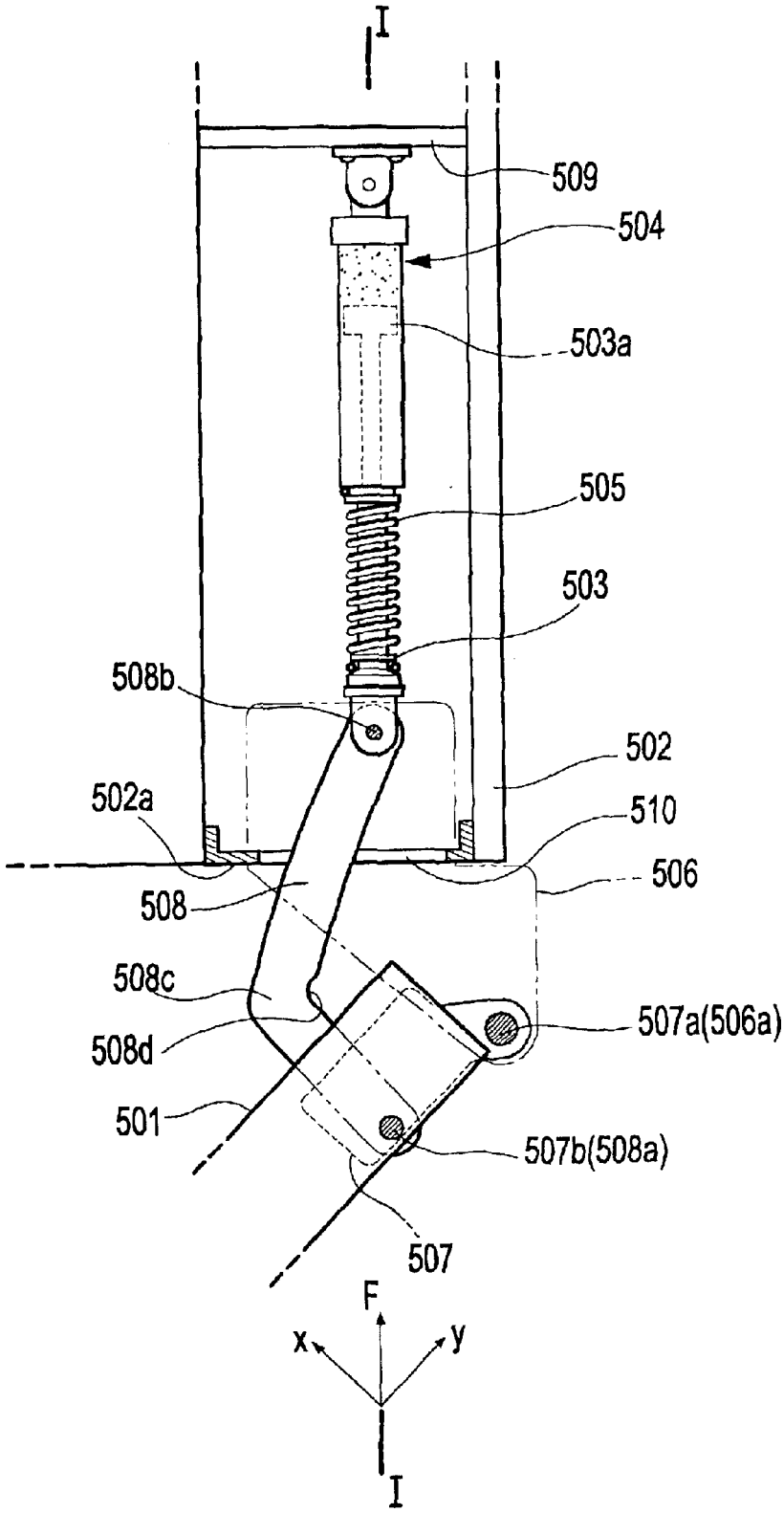
FIGS. 8 to 10 are plan views showing an operation of an apparatus to close a refrigerator door according to another embodiment of the present invention.

FIG. 6 is a plan view of the apparatus to close a refrigerator door shown in FIG. 5, in which the door 501 is closed, and FIG. 7 is a side cross-sectional view of the apparatus shown in FIG. 5, in which the door 501 is dosed. FIG. 8 shows the apparatus to close a refrigerator door according to the present invention, in which the door 501 is opened at a rotation angle of about 60 degrees.

As shown in FIG. 8, the door 501 is positioned to be inclined at about 30 degrees with respect to a virtual line "I—I", which is defined by an extension line from the movable shaft 503. Accordingly, a vector "F" of a tensional force applied to the door 501 may be decomposed into a component of an x-axis direction and a component of a y-axis direction, as illustrated in FIG. 8. In this case, the component force of x-axis serves to apply a rotational torque to the door 503, causing the door 503 to be automatically closed. As the opening angle of the door 503 is gradually reduced by the automatic closing motion of the door 503, the rotational torque applied to the door 503 becomes high, so that the door 503 is rotated and closed at an increasing speed. At this point, since the inside air in the enclosed space defined by the housing 504 and the piston 503*a* of the movable shaft 503 is suddenly compressed, the inside air acts on the movable shaft 503 as a counterforce. The counterforce is transmitted to the door 501 via the connecting lever 508, so that the closing speed of door 503 is reduced, thereby allowing the door 501 to be smoothly closed. When the door 501 is opened at an angle of 60 degrees or more, the rotational torque of the door 501 caused by the tension force "F" is gradually reduced. When the opening angle of the door 501 reaches a right angle, i.e., an angle of 90 degrees, the component force of the x-axis direction vanishes.

Figure 9:
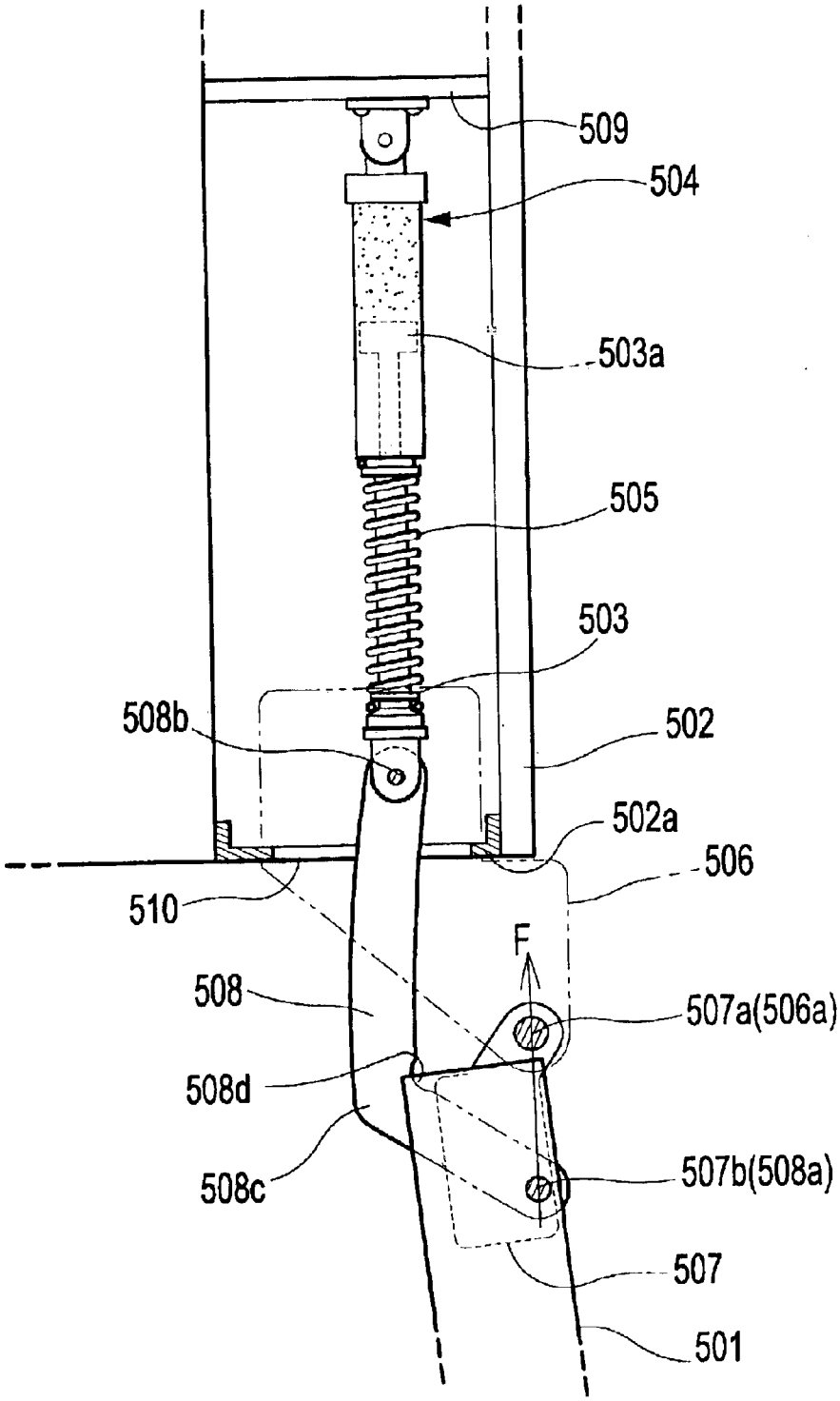

FIG. 9 shows the apparatus to close a refrigerator door according to an embodiment of the present invention, in which the door 501 is opened at a rotation angle of 90 to 135 degrees. More specifically, the door 501 is shown to be opened at a rotation angle of about 100 degrees. At this point, since the tension force "F" applied to the door 501 by the tension spring 505 acts in a direction coinciding with the extension line defined by the first hinge shaft 507*a* and the second hinge shaft 507*b*, the door is not applied with a rotational torque. Consequently, the door 501 remains in its position without rotation.

Figure 10:
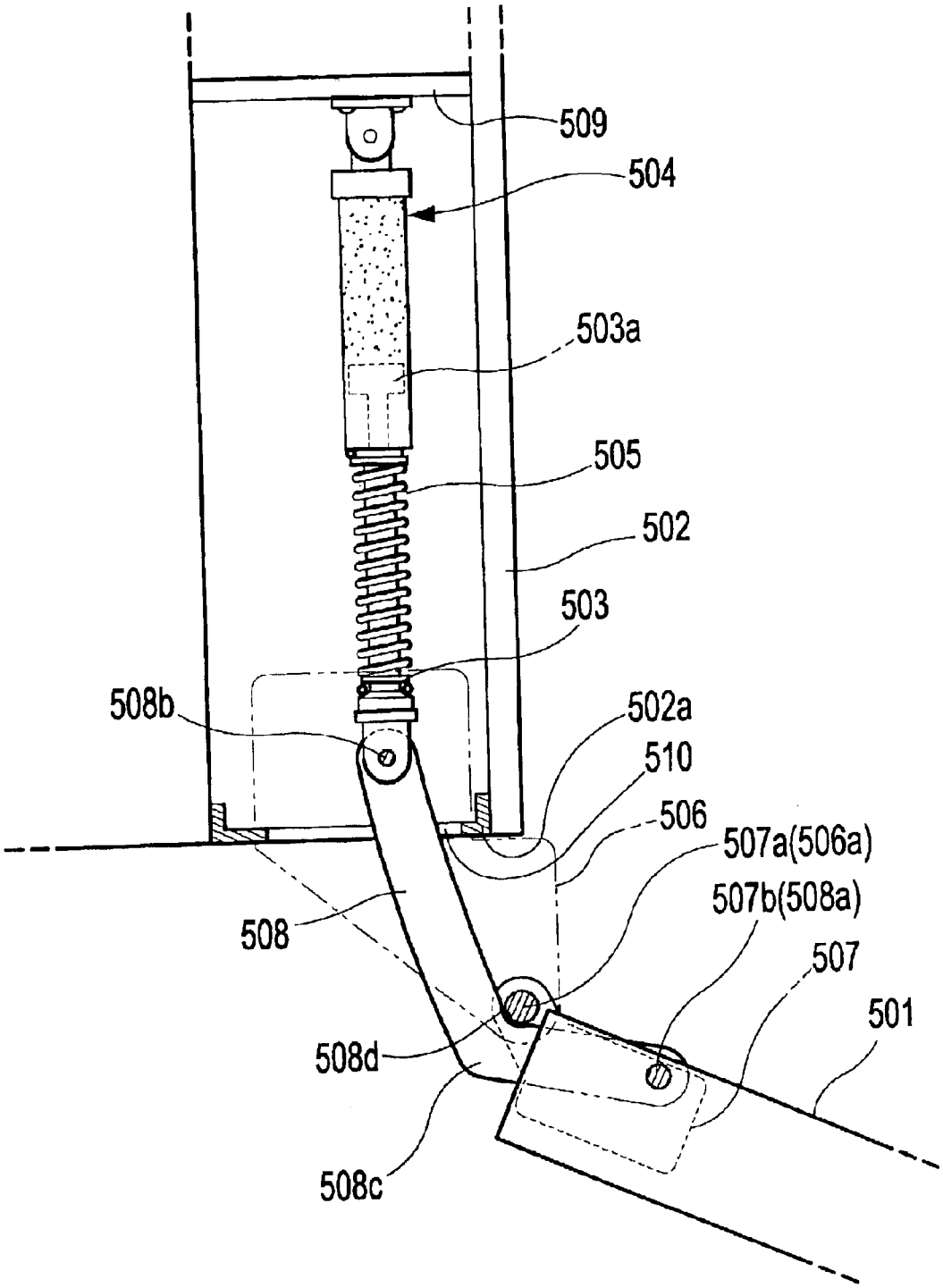

FIG. 10 shows the apparatus to close a refrigerator door according to an embodiment of the present invention, in which the door 501 is opened at the maximum rotation angle. In this embodiment, though the maximum rotation angle of the door is typically set to an angle of 135 degrees, the maximum rotation angle may be changed if necessary. To allow the door to have the maximum rotation angle of about 135 degrees, the connecting lever 508 is provided with a bent portion 508*c* where the first hinge shaft 507*a*, serving as a rotating shaft, comes into contact with the connecting lever 508. Furthermore, the connecting lever 508 is provided with a seat cut 508*d*, on which the first hinge shaft 507*a* is positioned.

Figure 11:
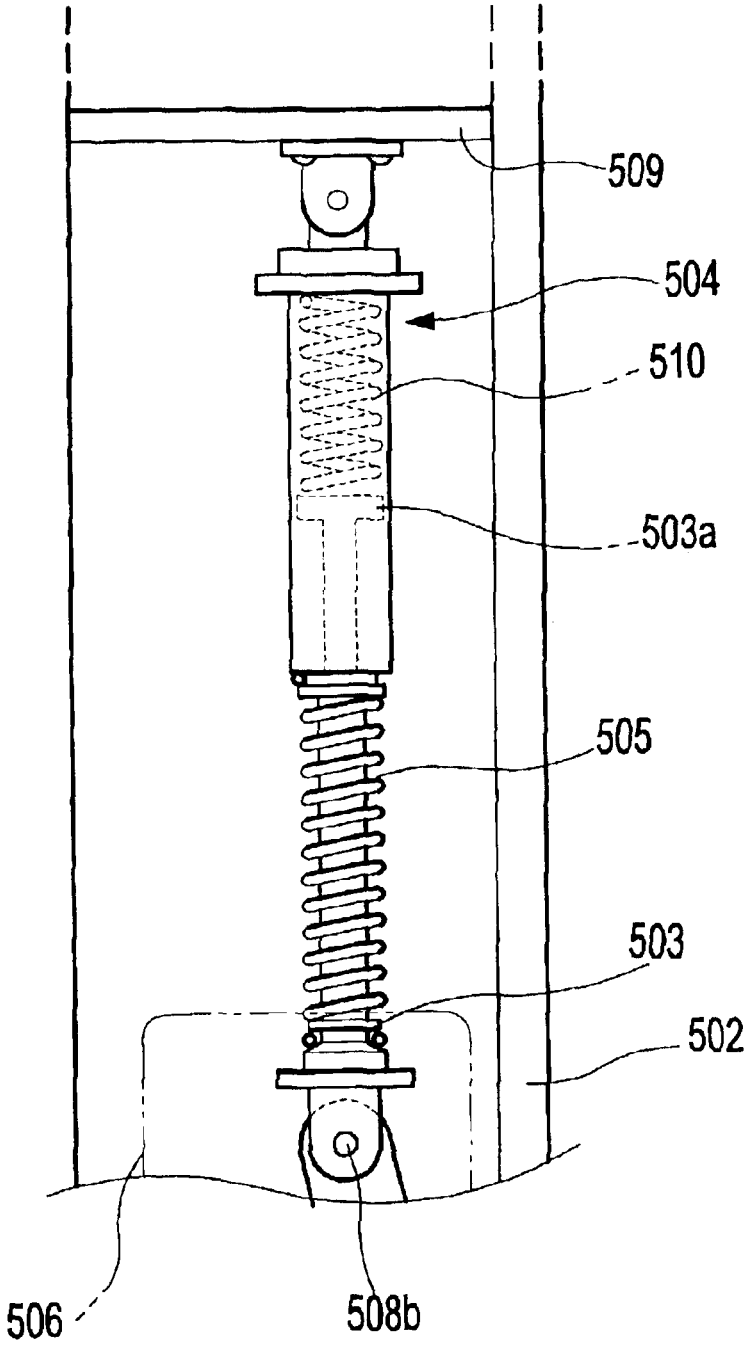
FIGS. 11 and 12 are plan views showing an apparatus according to further embodiments of the present invention.

FIG. 11 shows an apparatus according to another embodiment of the present invention, in which the housing 504 is provided therein with a shock-absorbing spring 510 to absorb shock generated by the door 501, unlike the above embodiment shown in FIGS. 5 to 10.

Figure 12:
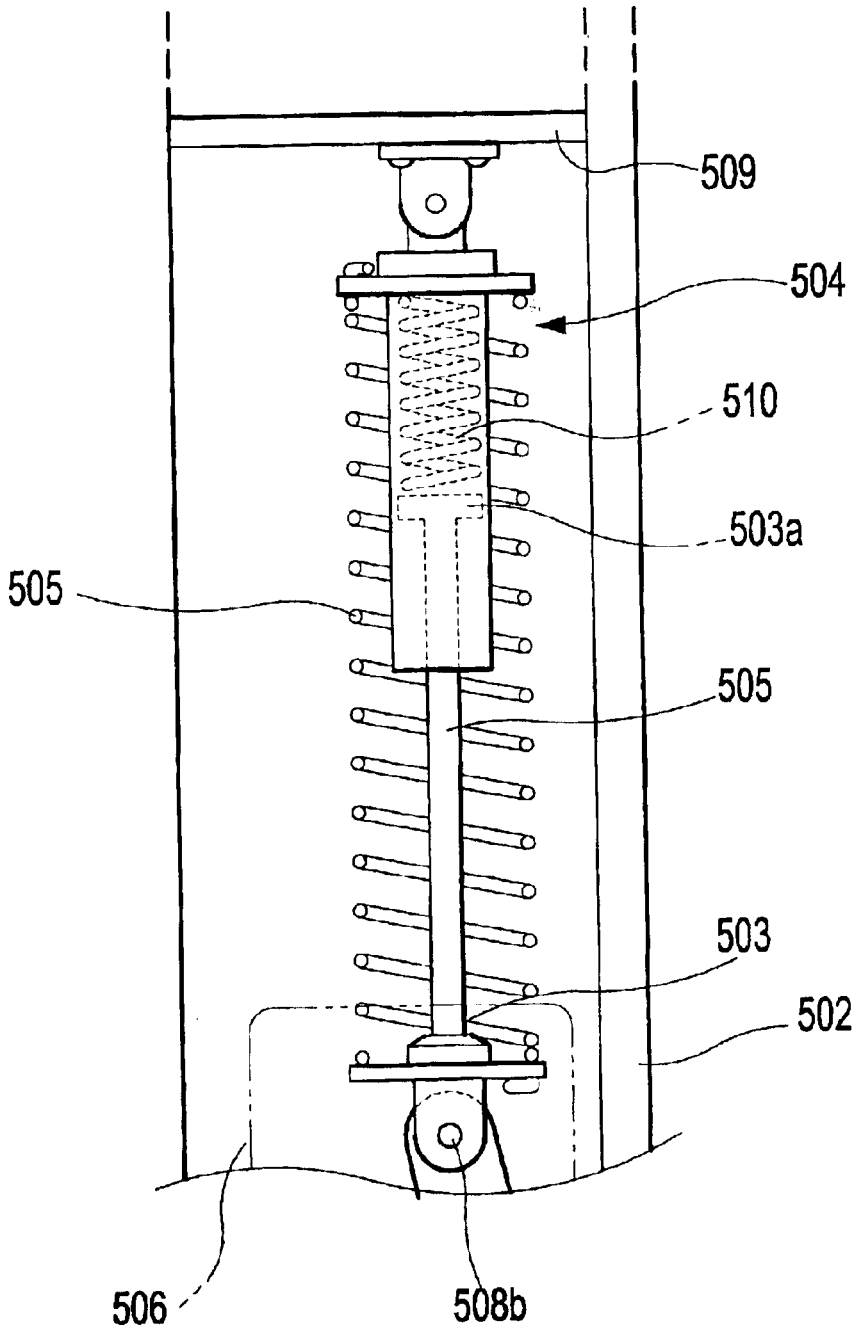

FIG. 12 shows an apparatus according to a further embodiment of the present invention which is different from the embodiments shown in FIGS. 5 to 10. In this embodiment, the rear end of the tension spring 505 is coupled to the rear end of the housing 504 adjacent to the mounting plate 509, unlike the above embodiment in which the rear end of the tension spring 505 is coupled to the front end of the housing 504.

Referring to FIGS. 13 to 17, there is shown an apparatus, according to a further embodiment of the present invention, which is adapted to control the maximum rotation angle of the door.

Figure 13:
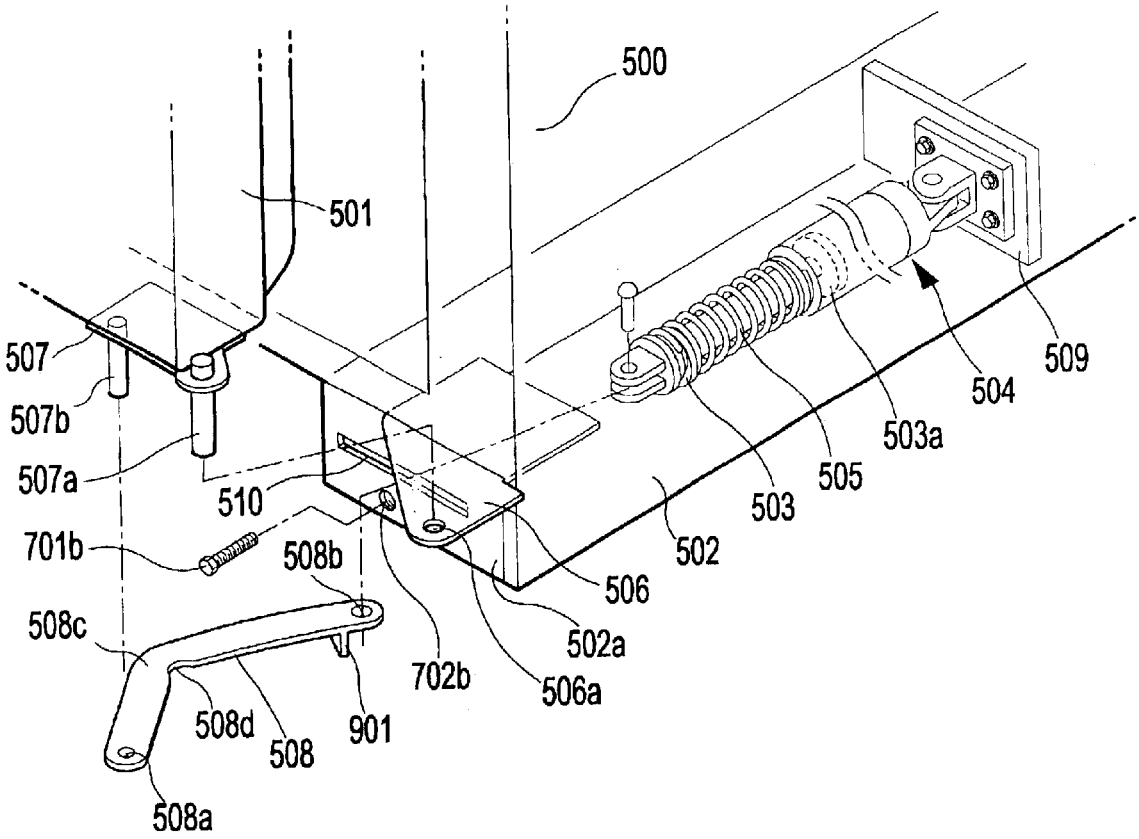

FIG. 13 is an exploded perspective view showing a configuration of the apparatus of this embodiment. The front plate 502*a* of the leg part 502, which includes the connecting lever hole 510, is provided with a female threaded hole 702*b*, which is engaged with a control bolt 701*b*. Consequently, the control bolt can be linearly moved with respect to the front plate 502*a*, by its rotation. Furthermore, the connecting lever 508 is provided at its lower surface adjacent to the hinge hole 508*b* with a stop protrusion 901, which comes into contact with the control bolt 701*b*. An operation of the apparatus according to this embodiment will now be described with reference to FIGS. 14 to 17.

Figure 14:
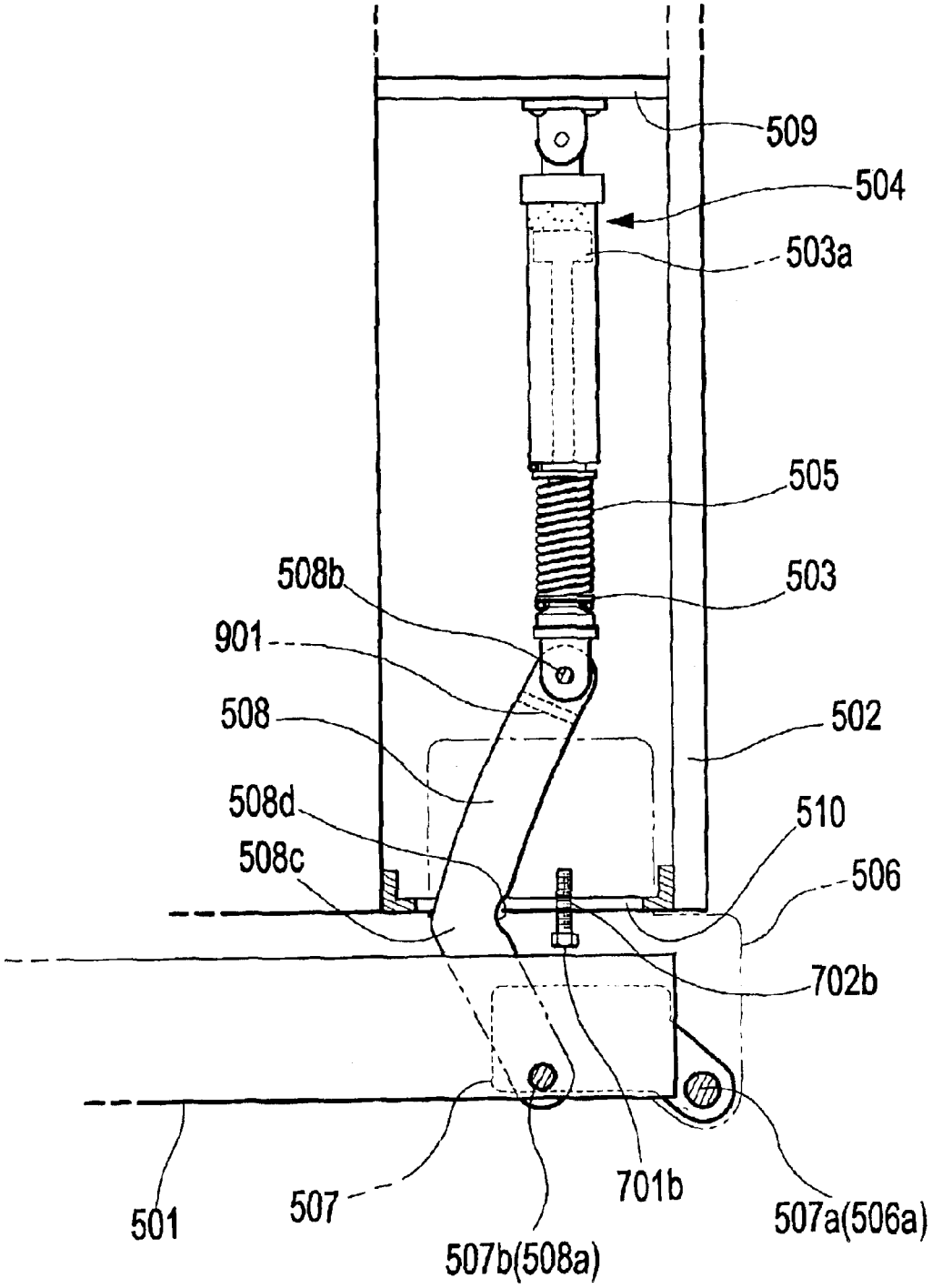
Figure 15:
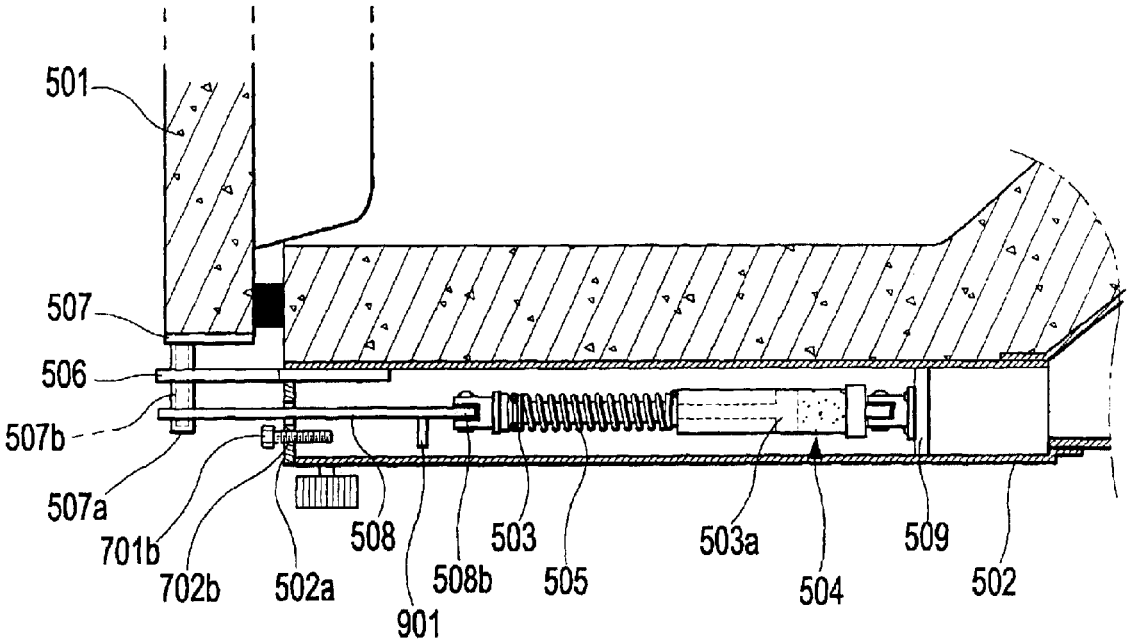

FIGS. 14 and 15 are a plan view and a side cross-sectional view showing the apparatus according to this embodiment, in which the door is closed.

Figure 16:
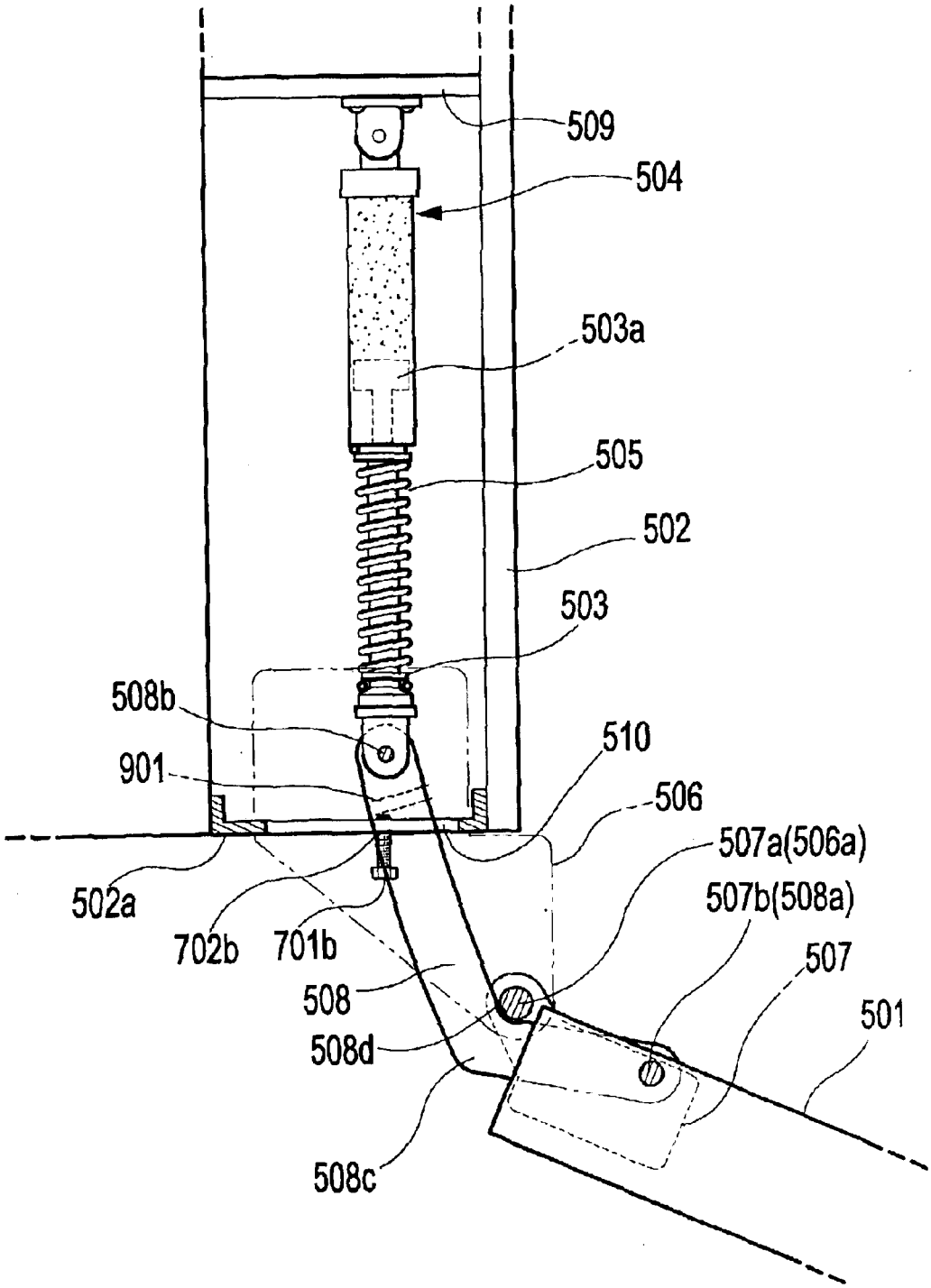

FIG. 16 shows the apparatus according to this embodiment, in which the door 501 is opened at the maximum rotation angle of 135 degrees, by loosening the control bolt 701*b*. The control bolt 701*b* may be projected into the leg part 502 by tightening the control bolt 701*b*, in accordance with a layout of furniture and appliances disposed around the refrigerator.

Figure 17:
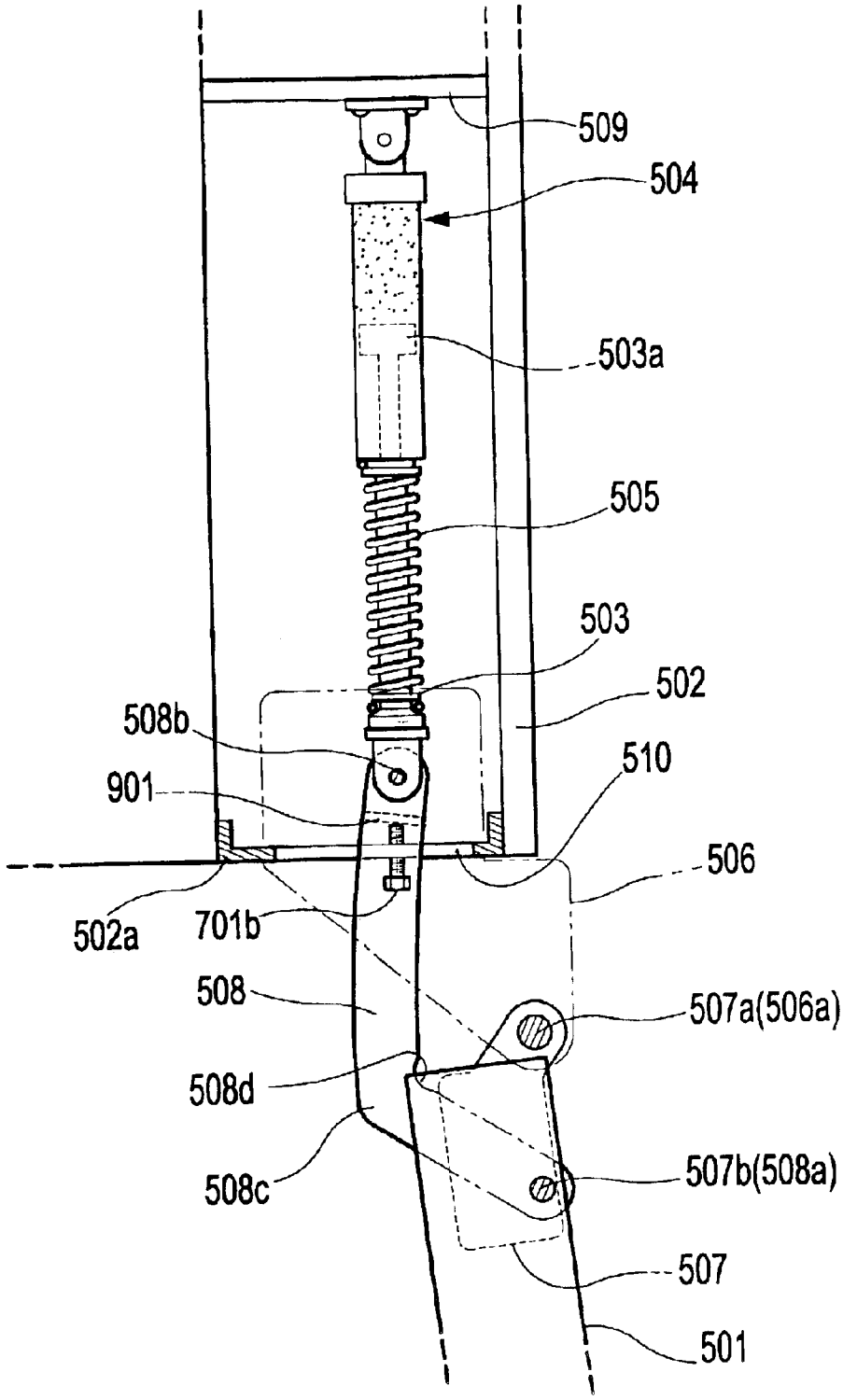

FIG. 17 shows the apparatus according to this embodiment, in which the control bolt 701*b* is somewhat protruded into the leg part 502 by rotating the control bolt 701*b*, so that the door 501 is opened to its controlled maximum rotation limit. In FIG. 17, the door 501 is shown to be opened at a rotation angle of about 100 degrees by control of the control bolt 701*b*. At this point, the stop protrusion 901 comes into contact with the control bolt 701*b* protruded into the leg part 502, thereby controlling the maximum rotation angle of the door 501 to an angle of about 100 degrees.

Although the maximum rotation angle of the door 501 is described to be set to an angle of about 100 degrees, the maximum rotation angle may be controlled by tightening of the control bolt. Accordingly, a user can control the maximum rotation angle of the door to any desired angle.

As apparent from the above description, the present invention provides an apparatus to close a refrigerator door which enables the door to be automatically closed when the door is opened within a range of 0 to 90 degrees, thereby preventing loss of electric power due to inadvertent opening of the door, and which enables the door to remain in its position when the door is opened within a range of 90 to 135 degrees, thereby enhancing convenient use of the refrigerator. In addition, since the apparatus according to the embodiments of the present invention is equipped with a shock-absorbing device to absorb shock generated by the door, the door is gently and smoothly dosed, thereby preventing food and articles placed on shelves of the door from falling and dropping down.

Furthermore, since a user can control the maximum rotation angle of the door of a refrigerator to a desired angle by the apparatus according to the embodiments of the present invention, the door of the refrigerator does not interfere with furniture and appliances disposed around the refrigerator. Accordingly, opening and closing operations of the door are convenient, and damage to the door is prevented.

Although a few preferred embodiments of the present invention have been shown and described with reference to FIGS. 5 to 17, it would be appreciated by those skilled in the art that changes may be made in these embodiments without departing from the principles and spirit of the invention, the scope of which is defined in the claims and their equivalents.

What is claimed is:

1. An apparatus to close a door of a refrigerator, comprising:

a hinge mechanism having a first hinge shaft provided at the door to allow the door to be coupled to a refrigerator cabinet and to allow the door to be rotated about the hinge shaft;

a tension spring provided in the refrigerator cabinet to apply a tension force to the door, to close the door;

a shock absorbing unit to absorb shock generated when the door is closed by the tension spring, the shock absorbing unit to absorb shock includes a housing coupled to the cabinet and a movable shaft which is received in the housing at one end and connected with the door at the other end to be linearly moved in the housing, and wherein the tension spring is connected with the cabinet at one end and connected with the movable shaft at the other end to apply the tension force to close the door.

2. The apparatus as set forth in claim 1, wherein the shock absorbing unit further comprises a piston provided at the one end of the movable shaft received in the housing so that air in a space defined by the housing and the piston absorbs shock generated by the quick closing of the door due to the tension force of the tension spring.

3. The apparatus as set forth in claim 1, wherein the shock absorbing unit further comprises:

a piston provided at the one end of the movable shaft received in the housing; and a shock-absorbing spring provided in the housing, wherein the piston and the shock absorbing spring absorb shock generated by the quick closing of the door due to the tension force of the tension spring.

4. The apparatus as set forth in claim 1, wherein the one end of the tension spring is connected to the housing.

5. The apparatus as set forth in claim 4, wherein the one end of the tension spring is connected to a front or rear end of the housing.

6. The apparatus as set forth in claim 1, further comprising a second hinge shaft provided at the door to be spaced from the first hinge shaft, and a connecting lever hingedly connected to the movable shaft at its one end and hingedly connected to the second hinge shaft to transmit the tension force of the tension spring to the door.

7. The apparatus as set forth in claim 6, further comprising a leg part which supports the refrigerator cabinet and serves as a cylinder, wherein the tension spring and the shock absorbing unit to absorb shock are provided in the leg part.

8. The apparatus as set forth in claim 7, wherein the leg part comprises a front plate provided with a connecting lever hole, to allow the connecting lever to freely pass therethrough while preventing the movable shaft from projecting to an outside of the leg part.

9. The apparatus as set forth in claim 8, further comprising a displacement control unit including a female threaded hole formed at the front plate of the leg part and a control bolt engaged with the female threaded hole, and a stop protrusion provided at the connecting lever, which comes into contact with the control bolt when the door is opened, thereby stopping the opening motion of the door.

10. The apparatus as set forth in claim 6, wherein the connecting lever is laterally bent at a region where the connecting lever comes into contact with the first hinge shaft to allow the door to be opened at a predetermined angle.

11. The apparatus as set forth in claim 6, wherein the connecting lever is provided with a seat cut at a region where the connecting lever comes into contact with the first hinge shaft to allow the first hinge shaft to seat in the seat cut, thereby allowing the door to be opened at a predetermined angle.

12. An apparatus to close a door of a refrigerator, comprising:

a hinge mechanism having first and second hinge shafts, to be coupled to a refrigerator cabinet and to allow the door to rotate;

a tension spring provided in the refrigerator cabinet to apply a tension force to the door, to close the door; and an absorbing unit to absorb the shock generated when the door is closed by the tension force, wherein when the door is opened within a range of 0 to 90 degrees, the tension force is applied to the door, and a rotational torque derived from the tension force is applied to the door, causing the door to automatically close, and when the door is opened within a range of 90 to 135 degrees, the tension force applied to the door moves in a direction corresponding to an extension line defined by the first and second hinge shafts, the rotational torque is not applied to the door, and the door remains in place.

* * * * *